US011381920B1

(12) United States Patent
Link

(10) Patent No.: US 11,381,920 B1
(45) Date of Patent: Jul. 5, 2022

(54) LOUDSPEAKER WITH ACOUSTICALLY TRANSPARENT SPIDER

(71) Applicant: Bose Corporation, Framingham, MA (US)

(72) Inventor: Christopher J. Link, Arlington, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/169,671

(22) Filed: Feb. 8, 2021

(51) Int. Cl.

| | |
|---|---|
| ***H04R 9/04*** | (2006.01) |
| ***H04R 1/02*** | (2006.01) |
| ***H04R 9/06*** | (2006.01) |
| ***H04R 7/18*** | (2006.01) |
| ***H04R 7/12*** | (2006.01) |
| ***H04R 9/02*** | (2006.01) |

(52) U.S. Cl.
CPC ..... *H04R 9/043* (2013.01); *H04R 1/025* (2013.01); *H04R 7/12* (2013.01); *H04R 7/18* (2013.01); *H04R 9/025* (2013.01); *H04R 9/06* (2013.01); *H04R 2499/13* (2013.01)

(58) Field of Classification Search
CPC ..... H04R 9/043; H04R 1/025; H04R 7/12; H04R 7/18; H04R 9/025; H04R 9/06; H04R 2499/13
USPC ..... 381/86
See application file for complete search history.

(56) References Cited

U.S. PATENT DOCUMENTS

| | | | | |
|---|---|---|---|---|
| 6,111,969 A * | 8/2000 | Babb | H04R 9/063 381/396 |
| 2002/0106101 A1* | 8/2002 | White | H04R 9/022 381/407 |
| 2007/0217644 A1* | 9/2007 | LeDonne | H04R 5/023 381/396 |
| 2020/0124270 A1* | 4/2020 | Spencer | H04R 3/12 |

* cited by examiner

*Primary Examiner* — Sean H Nguyen
(74) *Attorney, Agent, or Firm* — Bose Corporation

(57) ABSTRACT

A loudspeaker is provided that includes a housing, a diaphragm, and a suspension. The diaphragm has a front side for the production of acoustic output. The suspension is coupled to the front side of the diaphragm at a central edge of the suspension and coupled to the housing at an outer edge of the suspension. The suspension is positioned in front of the diaphragm such that the acoustic output passes through the suspension when in use. The loudspeaker may be provided in one of a roof or headliner of a vehicle or a headrest of a vehicle.

19 Claims, 5 Drawing Sheets

CROSS SECTION A-A

CROSS SECTION A-A

LOUDSPEAKER WITH ACOUSTICALLY TRANSPARENT SPIDER

BACKGROUND

In various sound systems, it may be desirable to include installed loudspeakers in components of an environment, such as in walls of a room, doors of a vehicle, etc. Further, with the advent of immersive 3-dimensional surround sound systems, it may be desirable to include loudspeakers in an elevated position, such as in a ceiling or headliner of a vehicle, or in a headrest. In numerous such environments there may be limited room, especially depth, for an installed loudspeaker. Accordingly, there exists a need for a loudspeaker that requires only minimal depth for installation.

SUMMARY

Systems and methods disclosed herein are directed to loudspeakers having a compact depth, e.g., front-to-back when mounted in a wall or door and top-to-bottom when mounted in a ceiling, roof, or headliner. According to various examples, a motor of the loudspeaker may be reverse-mounted, such that a sound-producing diaphragm is inverted relative to a conventional speaker design. For example, an 'inside' face of a diaphragm cone may face the motor such that the motor (e.g., a magnetic circuit and voice coil, for instance) is somewhat 'inside' the cone of the diaphragm (e.g., see FIG. 3).

In various examples, the diaphragm may be suspended by two suspension components, a surround at the outer edge of the diaphragm and a spider coupled to a more central location of the diaphragm, often but not necessarily aligned with a drive point of the motor. According to various aspects of the instant disclosure, the spider is acoustically transparent and the loudspeaker is configured to produce acoustic output through the spider. By comparison, conventional speakers are configured to produce audio output without passing through the spider.

Various aspects include loudspeakers having an inverted diaphragm configuration, configured to produce acoustic output from the rear or back side of the diaphragm, for the acoustic output to pass through an acoustically transparent spider, and may be dimensioned to serve in a mid-range or higher acoustic frequency band, e.g., may be dimensioned to be substantially unsuitable to serve in a bass acoustic frequency band, such that the loudspeaker may be substantially unsuitable as a woofer or subwoofer.

According to at least one aspect, a loudspeaker is provided that includes a housing, a diaphragm coupled to the housing and having a front side for the production of acoustic output when in use, and a suspension coupled to the front side of the diaphragm at a central edge of the suspension and coupled to the housing at an outer edge of the suspension, the suspension positioned in front of the diaphragm such that the acoustic output passes through the suspension when in use.

In various examples, a diameter of the suspension may be substantially the same as a diameter of the diaphragm. In some examples, the diameter is 3.0 inches or less. In some examples, the diameter is 2.5 inches or less. In certain examples, the diameter is 2.5 inches or less.

According to various examples, the diaphragm is dimensioned to operate in a frequency range of about 100 Hz and higher. In some examples, the diaphragm is dimensioned to operate in a frequency range of about 150 Hz and higher. In certain examples, the diaphragm is dimensioned to operate in a frequency range of about 200 Hz and higher.

In some examples, the housing includes a front portion that at least partially forms a substantially sealed acoustic volume between the front side of the diaphragm and the suspension. Some examples include a voice coil coupled to the diaphragm and a magnetic circuit at least partially supported by a back portion of the housing, the voice coil suspended with a magnetic field of the magnetic circuit. In certain examples the back portion of the housing may acoustically couple a back side of the diaphragm to the surrounding environment.

According to another aspect, an automobile is provided that includes an interior cabin for the accommodation of occupants, a roof, and a transducer coupled to the roof. The transducer includes a housing, a diaphragm coupled to the housing and having a front side for the production of acoustic output when in use, and a suspension coupled to the front side of the diaphragm at a central edge of the suspension and coupled to the housing at an outer edge of the suspension, the suspension positioned in front of the diaphragm such that the acoustic output passes through the suspension when in use. The transducer is coupled to the roof such that the acoustic output is directed into the interior cabin when in use.

In some examples the transducer has a diameter of 3.0 inches or less.

In some examples the diaphragm is dimensioned to operate in a frequency range of about 100 Hz and higher.

According to various examples, the housing may include a front portion that at least partially forms a substantially sealed acoustic volume between the front side of the diaphragm and the suspension.

According to yet another aspect, a headrest is provided that includes an enclosure configured to accommodate a loudspeaker and a loudspeaker coupled to the enclosure. The loudspeaker includes a housing, a diaphragm coupled to the housing and having a front side for the production of acoustic output when in use, and a suspension coupled to the front side of the diaphragm at a central edge of the suspension and coupled to the housing at an outer edge of the suspension, the suspension positioned in front of the diaphragm such that the acoustic output passes through the suspension when in use.

In some examples the transducer has a diameter of 3.0 inches or less.

In some examples the diaphragm is dimensioned to operate in a frequency range of about 100 Hz and higher.

According to various examples, the housing may include a front portion that at least partially forms a substantially sealed acoustic volume between the front side of the diaphragm and the suspension.

Still other aspects, examples, and advantages of these exemplary aspects and examples are discussed in detail below. Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples and are incorporated in and constitute a part of this specification but are not intended as a definition of the limits of the invention(s). In the figures, identical or nearly identical components illustrated in various figures may be represented by a like reference character or numeral. For purposes of clarity, not every component may be labeled in every figure. In the figures.

DETAILED DESCRIPTION

Figure 1:
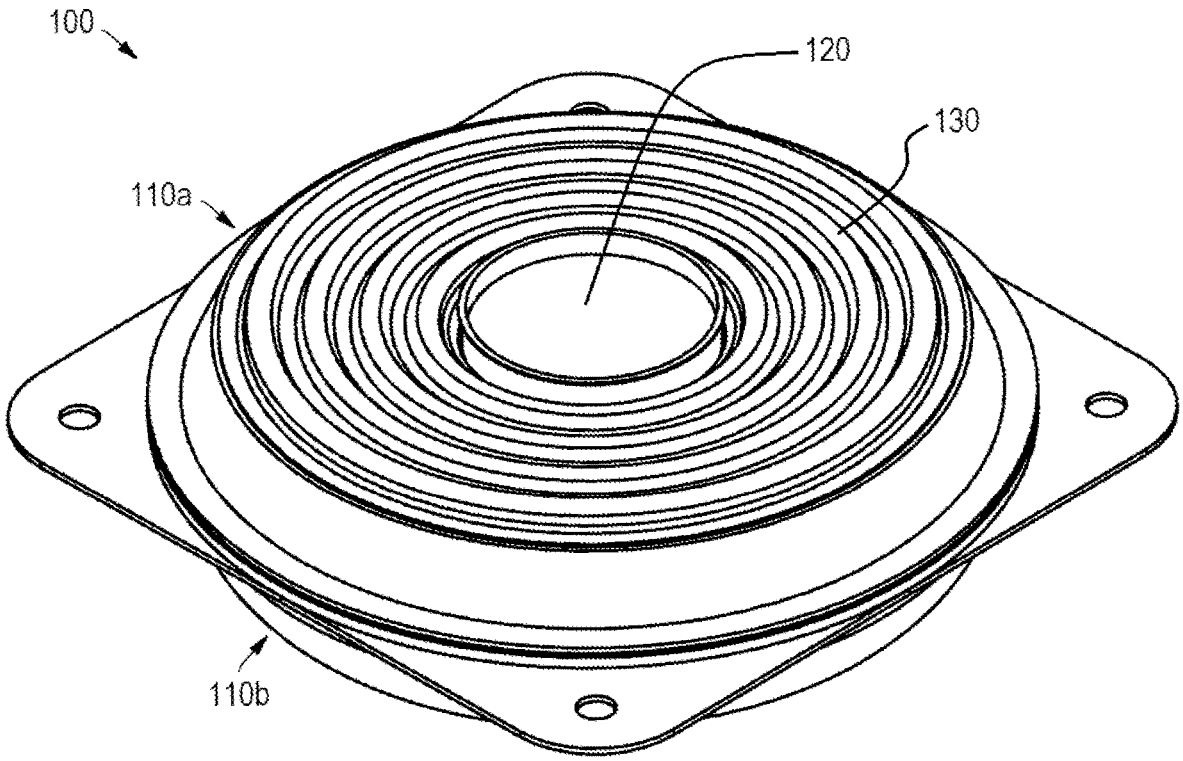
FIG. 1 is a perspective view of an example loudspeaker.

FIG. 1 illustrates an exterior perspective view of a loudspeaker 100 in accord with various aspects disclosed herein. The loudspeaker 100 includes a housing 110, e.g., an enclosure, having a front portion 110*a* and a back portion 110*b*. The loudspeaker 100 includes a central region 120 on a front side that is surrounded by and at least partially suspended by a spider 130. An outer edge of the spider 130 is coupled to the housing 110. Beneath the spider 130 and inside the housing 110 is a diaphragm 140 (see FIGS. 3-5) from which acoustic energy is produced that propagates through the spider 130. In various examples, a diameter of the spider 13—may be substantially the same as a diameter of the diaphragm 140.

Figure 2:
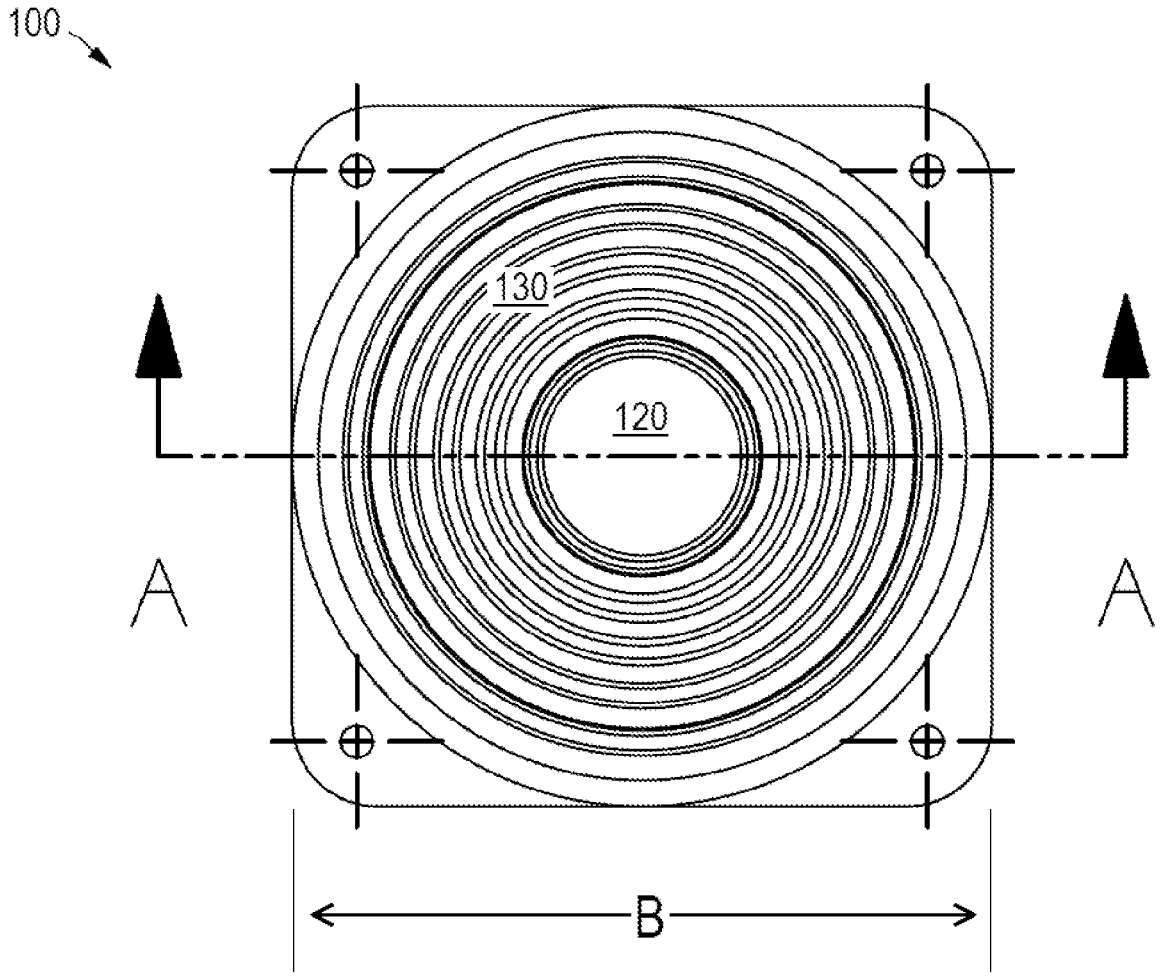
FIG. 2 is a plan view of the example loudspeaker of FIG. 1.
Figure 3:
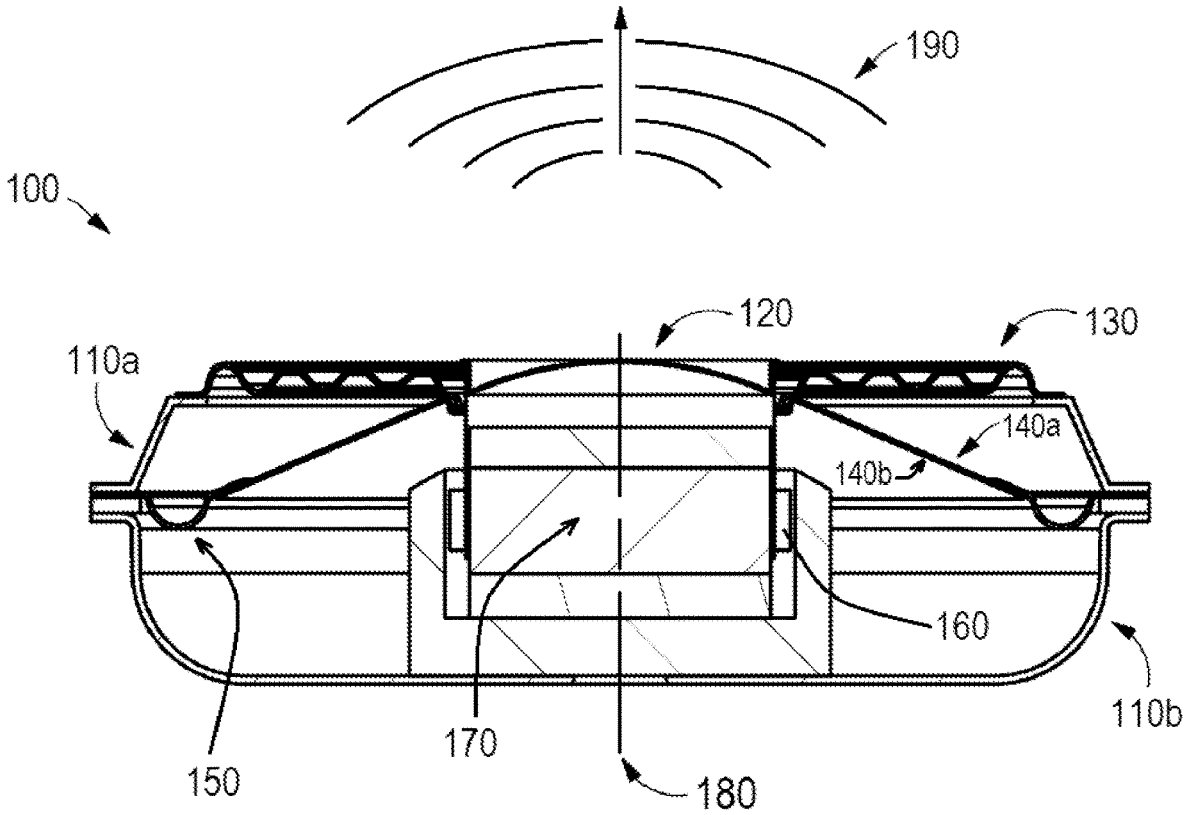
FIG. 3 is a cross-sectional view of one example of an interior of the loudspeaker of FIG. 1.
Figure 4:
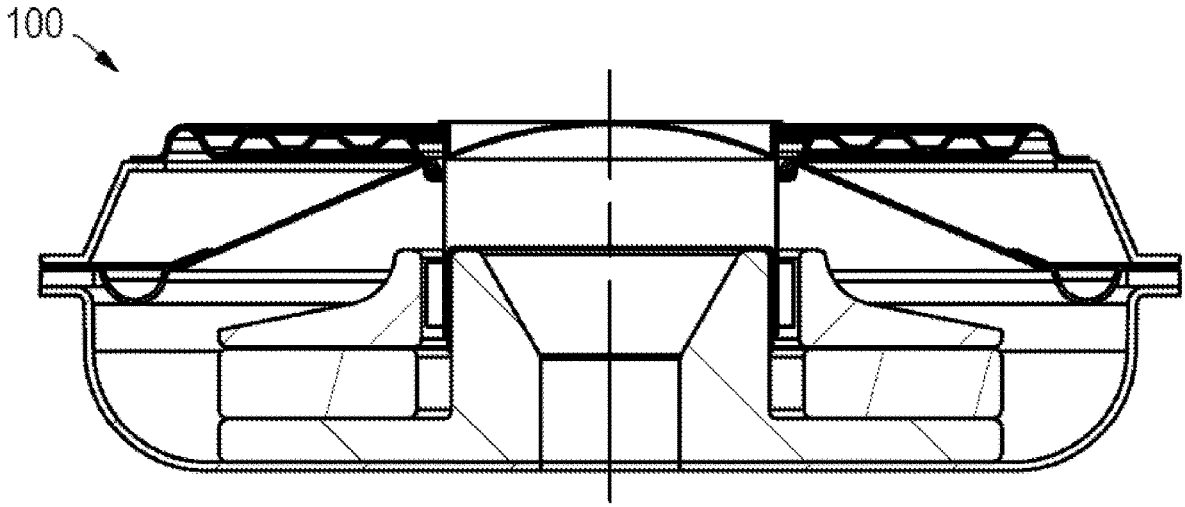
FIG. 4 is a cross-sectional view of another example of an interior of the loudspeaker of FIG. 1.
Figure 5:
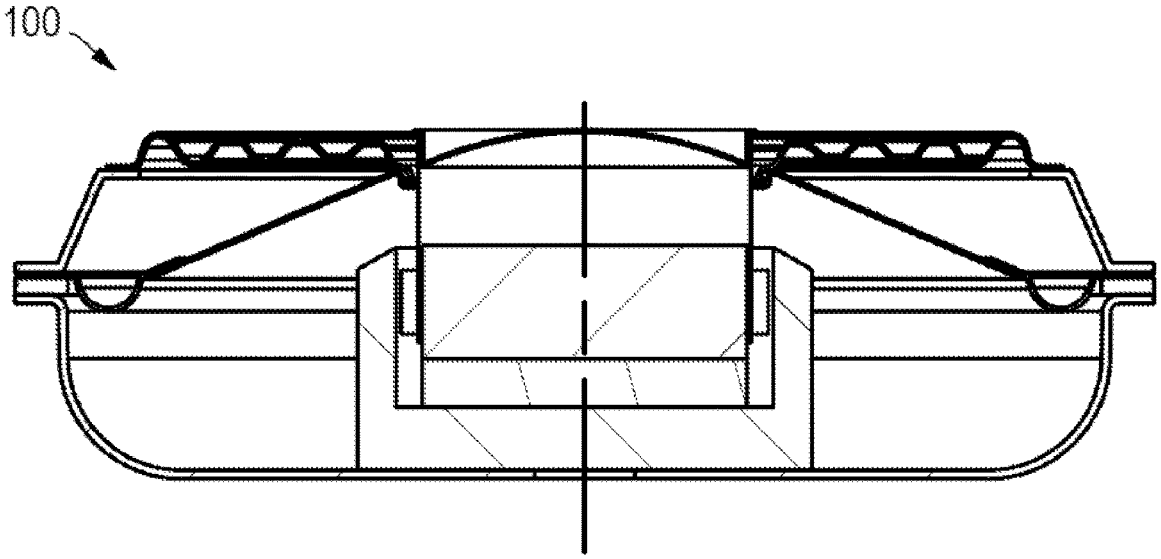
FIG. 5 is a cross-sectional view of another example of an interior of the loudspeaker of FIG. 1.

FIG. 2 illustrates the loudspeaker 100 from a different view and illustrates a cross-sectional position A-A (referenced with respect to FIGS. 3-5) and a dimension B, which is approximately a diameter of the spider 130 and is approximately a diameter of the interior diaphragm 140 (shown in FIGS. 3-5). According to various examples, the dimension B is 3.0 inches or less. In some examples the dimension B is 2.5 inches or less, while in certain examples the dimension B is 2.0 inches or less. In various examples, the loudspeaker 100 is configured with a dimension B to be suitable for producing acoustic waves at a frequency of about 100 Hz and higher. In some examples the loudspeaker 100 is suitable for producing acoustic waves at a frequency of about 150 Hz or higher, while in certain examples the loudspeaker 100 may be suitable for producing acoustic waves at a frequency of about 200 Hz or higher. Accordingly, in various examples, the loudspeaker 100 is configured with a dimension B to be relatively unsuitable for producing acoustic waves below about 100 Hz. In some examples the loudspeaker 100 is relatively unsuitable for producing acoustic waves below about 150 Hz, while in certain examples the loudspeaker 100 may be relatively unsuitable for producing acoustic waves below about 200 Hz.

FIG. 3 is a cross-sectional view (at position A-A of FIG. 2) of at least one example of an interior of the loudspeaker 100. The diaphragm 140 is at least partially supported by the spider 130 (a first suspension) and at least partially supported by a surround 150 (a second suspension).

FIG. 3 also illustrates an interior motor that includes a voice coil 160 and a magnetic circuit 170. The voice coil is mechanically coupled to the diaphragm 140 and thereby suspended in a magnetic field produce by the magnetic circuit 170. An electric current through the voice coil 160 creates an additional magnetic field that interacts with the magnetic field of the magnetic circuit 170 to exert a force the diaphragm 140 and cause movement of the diaphragm 140 along an axis 180, thereby producing an acoustic output 190 that passes through the spider 130.

According to various examples, various alternate forms of motor arrangement may be suitable for the loudspeaker 100, two of which are illustrated in FIG. 4 and FIG. 5 respectively, each of which include a voice coil and a magnetic circuit, though other arrangements or styles of motor may also be suitable.

With continuing reference to FIG. 3, the spider 130 is made from an acoustically transparent material and the diaphragm 140 produces acoustic output (sound pressure) off of a front side 140*a* that propagates through the acoustically transparent spider 130. In various examples, the spider 130, the diaphragm 140, the surround 150, and the front portion 110*a* of the housing 110 may form a substantially sealed acoustic volume. Some examples may include a bleed or vent hole, or other component, to allow for pressure inside the acoustic volume to equalize with an exterior pressure. Other examples may include openings to provide tuning of the overall output, e.g., to affect a frequency response of the loudspeaker 100.

The diaphragm 140 also has a rear side 140*b*. In general, the diaphragm 140 has a conical shape, or more accurately in some examples the diaphragm 140 is a frustum, e.g., because the diaphragm 140 may not include an apex or vertex. In various examples, the loudspeaker 100 is inverted in that an 'inside' portion of the diaphragm 140 is the rear side 140*b*, e.g., the motor is on the 'inside' of the cone or frustum of the diaphragm 140, which is an inverse of conventional speaker systems. Accordingly, acoustic output is produced from the 'outside' of the cone or frustum of the diaphragm 140.

The back portion 110*b* of the housing 110 is a frame that provides structural support to the motor and an outer edge of the surround 150. According to various examples, the back portion 110*b* of the housing 110 may acoustically couple the rear side 140*b* of the diaphragm 140 to the surrounding environment, such as by having openings in the back portion 110*b* of the housing 110. In such cases, the back portion 110*b* of the housing 110 may be considered a basket. The loudspeaker 100 may, in some examples, be mounted or coupled to other structures, such as various acoustic volumes, ports, etc., that may provide tuning of the overall output, e.g., to affect a frequency response of the loudspeaker 100.

Figure 6:
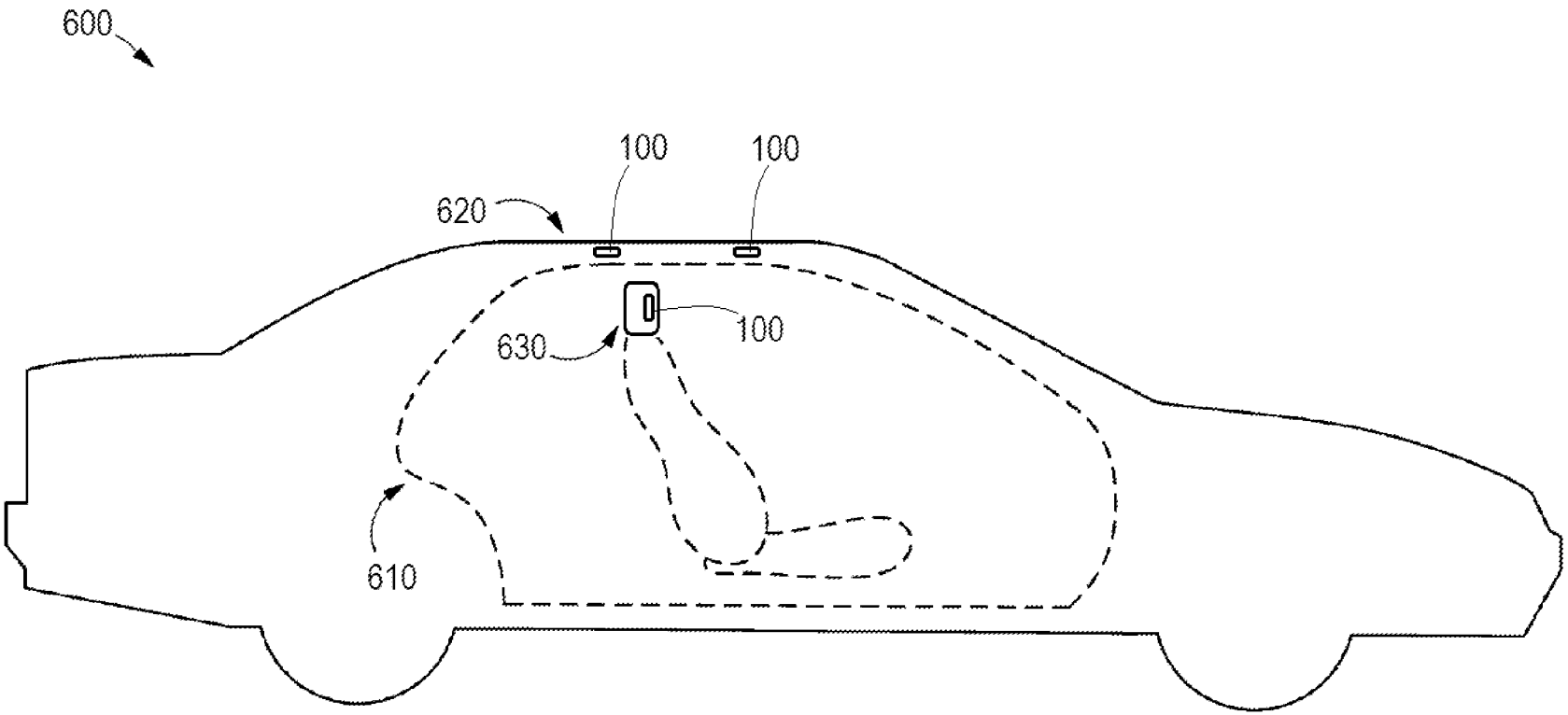
FIG. 6 is a schematic view of an automobile wherein an example loudspeaker may be utilized.

Because the loudspeaker 100 in accord with aspects disclosed herein produces acoustic output from a front side 140*a* of the diaphragm 140 and through the spider 130, the loudspeaker 100 is suitable for installation with the spider 130 facing toward the intended direction of acoustic output (unlike conventional speakers). For example, in a vehicle or automobile cabin, the loudspeaker 100 may be mounted in or coupled to a roof or headliner such that the spider 130 faces substantially downward. In another example in a vehicle or automobile cabin, the loudspeaker 100 may be mounted in or coupled to a headrest of a seat such that the spider 130 faces generally forward, or may be angled outward from forward, to be heard by an occupant of the seat. In other examples, the loudspeaker 100 may be mounted in or coupled to a door or other structural boundary of a vehicle cabin such that the spider 130 faces generally inward to the cabin. FIG. 6 illustrates an automobile 600 having an interior cabin 610 with examples of the loudspeaker 100 installed in various positions, including a roof or headliner 620 and a headrest 630.

The central region 120 may include a cap or cover and may or may not be considered part of the diaphragm 140 in various examples. The central region 120 may contribute to the acoustic output and therefore may conventionally be considered to contribute to the function of the diaphragm 140 even though the central region 120 may not be part of the conical and/or frustum form. In some examples the central region 120 may be an extended portion of a material from which the spider 130 is constructed, or a material from which the diaphragm 140 is constructed, or may be a different material.

The herein illustrated shapes of the various components described, such as the housing 110, spider 130, diaphragm 140, surround 150, voice coil 160, and magnetic circuit 170, are not necessarily intended to be limiting, unless the context clearly makes it so. Various examples may include alternate shapes for the various components described so long as the alternate is capable of satisfying the function of that component described herein.

Examples of the methods and apparatuses discussed herein are not limited in application to the details of construction and the arrangement of components set forth in the above descriptions or illustrated in the accompanying drawings. The methods and apparatuses are capable of implementation in other examples and of being practiced or of being carried out in various ways. Examples of specific implementations are provided herein for illustrative purposes only and are not intended to be limiting. Various functions, components, elements, and features discussed in connection with any one or more examples are not intended to be excluded from a similar role in any other examples.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

Also, the phraseology and terminology used herein is for the purpose of description and should not be regarded as limiting. Any references to examples, components, elements, acts, or functions of the systems and methods herein referred to in the singular may also embrace embodiments including a plurality, and any references in plural to any example, component, element, act, or function herein may also embrace examples including only a singularity. Accordingly, references in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation, unless the context reasonably implies otherwise.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A loudspeaker comprising:

a housing;

a diaphragm coupled to the housing and having a front side for the production of acoustic output when in use; and a suspension coupled to the front side of the diaphragm at a central edge of the suspension and coupled to the housing at an outer edge of the suspension, the suspension positioned in front of the diaphragm such that the acoustic output passes through the suspension when in use.

2. The loudspeaker of claim 1 wherein a diameter of the suspension is substantially the same as a diameter of the diaphragm.

3. The loudspeaker of claim 2 wherein the diameter is 3.0 inches or less.

4. The loudspeaker of claim 2 wherein the diameter is 2.5 inches or less.

5. The loudspeaker of claim 2 wherein the diameter is 2 inches or less.

6. The loudspeaker of claim 1 wherein the diaphragm is dimensioned to operate in a frequency range of about 100 Hz and higher.

7. The loudspeaker of claim 1 wherein the diaphragm is dimensioned to operate in a frequency range of about 150 Hz and higher.

8. The loudspeaker of claim 1 wherein the diaphragm is dimensioned to operate in a frequency range of about 200 Hz and higher.

9. The loudspeaker of claim 1 wherein the housing includes a front portion that at least partially forms a substantially sealed acoustic volume between the front side of the diaphragm and the suspension.

10. The loudspeaker of claim 9 further comprising a voice coil coupled to the diaphragm and a magnetic circuit at least partially supported by a back portion of the housing, the voice coil suspended with a magnetic field of the magnetic circuit.

11. The loudspeaker of claim 10 wherein the back portion of the housing acoustically couples a back side of the diaphragm to the surrounding environment.

12. An automobile comprising:

an interior cabin for the accommodation of occupants;

a roof; and a transducer coupled to the roof, the transducer comprising:

a housing, a diaphragm coupled to the housing and having a front side for the production of acoustic output when in use, and a suspension coupled to the front side of the diaphragm at a central edge of the suspension and coupled to the housing at an outer edge of the suspension, the suspension positioned in front of the diaphragm such that the acoustic output passes through the suspension when in use, wherein the transducer is coupled to the roof such that the acoustic output is directed into the interior cabin when in use.

13. The automobile of claim 12 wherein the transducer has a diameter of 3.0 inches or less.

14. The automobile of claim 12 wherein the diaphragm is dimensioned to operate in a frequency range of about 100 Hz and higher.

15. The automobile of claim 12 wherein the housing includes a front portion that at least partially forms a substantially sealed acoustic volume between the front side of the diaphragm and the suspension.

16. A headrest comprising:

an enclosure configured to accommodate a loudspeaker; and a loudspeaker coupled to the enclosure, the loudspeaker comprising:

a housing, a diaphragm coupled to the housing and having a front side for the production of acoustic output when in use, and a suspension coupled to the front side of the diaphragm at a central edge of the suspension and coupled to the housing at an outer edge of the suspension, the suspension positioned in front of the diaphragm such that the acoustic output passes through the suspension when in use.

17. The headrest of claim 16 wherein the loudspeaker has a diameter of 3.0 inches or less.

18. The headrest of claim 16 wherein the diaphragm is dimensioned to operate in a frequency range of about 100 Hz and higher.

19. The headrest of claim 16 wherein the housing includes a front portion that at least partially forms a substantially sealed acoustic volume between the front side of the diaphragm and the suspension.

* * * * *